US006343388B1

(12) United States Patent
Lebrun

(10) Patent No.: US 6,343,388 B1
(45) Date of Patent: Feb. 5, 2002

(54) SHOWERING DEVICE

(76) Inventor: Cedric Lebrun, 72-15 Dane Pl., Forest Hills, NY (US) 11375

( * ) Notice: Subject to any disclaimer, the term of this patent is extended or adjusted under 35 U.S.C. 154(b) by 0 days.

(21) Appl. No.: 09/635,045

(22) Filed: Aug. 4, 2000

(51) Int. Cl.[7] ..... A61H 33/00
(52) U.S. Cl. ..... 4/541.3; 4/559
(58) Field of Search ..... 4/541.1, 541.3, 4/541.4, 559

(56) References Cited

U.S. PATENT DOCUMENTS

| | | | | |
|---|---|---|---|---|
| 3,286,712 A | * | 11/1966 | Roden | 4/541.4 X |
| D265,127 S | | 6/1982 | Cousins | |
| 4,655,197 A | | 4/1987 | Atkinson | |
| 4,801,378 A | | 1/1989 | Desjoyaux et al. | |
| 4,872,224 A | | 10/1989 | Grimes et al. | |
| D337,149 S | | 7/1993 | Desjoyaux et al. | |
| 5,233,706 A | | 8/1993 | Maehr | |
| 5,408,707 A | * | 4/1995 | Wilson | 4/541.1 |

* cited by examiner

*Primary Examiner*—Robert M. Fetsuga

(57) ABSTRACT

A new showering device for enabling a user to shower for extended periods of time without using a substantial volume of water. The inventive device includes a housing unit having a hollow interior, a pump having an inlet and outlet, the pump being disposed within the housing unit. A heater is included within the pump to heat water passing through the pump. An elongate intake hose has an output end connected to the pump inlet and an intake end extending outwardly from the housing unit. An intake nozzle is connected to the intake hose intake end and has an intake opening for positioning within a reservoir containing water. An intake filter is provided within the intake nozzle to aid filtration of water passing into the intake nozzle. An elongate output hose is connected to the pump outlet at its intake end and has a shower head nozzle connected to its output end. The shower head nozzle has an opening to permit showering using water passing through the output hose. To filter and purify water passing through the intake hose, a primary filter is disposed between the intake hose output end and the pump inlet.

1 Claim, 2 Drawing Sheets

SHOWERING DEVICE

BACKGROUND OF THE INVENTION

1. Field of the Invention

The present invention relates to showering devices and more particularly pertains to a new showering device for enabling a user to shower for extended periods of time without using a substantial volume of water.

2. Description of the Prior Art

The use of showering devices is known in the prior art. More specifically, showering devices heretofore devised and utilized are known M20 to consist basically of familiar, expected and obvious structural configurations, notwithstanding the myriad of designs encompassed by the crowded prior art which have been developed for the fulfillment of countless objectives and requirements.

Known prior art showering devices include U.S. Pat. No. 4,801,378; U.S. Pat. No. 4,872,224; U.S. Pat. No. Des. 337,149; U.S. Pat. No. 5,233,706; U.S. Pat. No. 4,655,197; and U.S. Pat. No. Des. 265,127.

While these devices fulfill their respective, particular objectives and requirements, the aforementioned patents do not disclose a new showering device. The inventive device includes a housing unit having a hollow interior, a pump having an inlet and outlet, the pump being disposed within the housing unit. A heater is included within the pump to heat water passing through the pump. An elongate intake hose has an output end connected to the pump inlet and an intake end extending outwardly from the housing unit. An intake nozzle is connected to the intake hose intake end and has an intake opening for positioning within a reservoir containing water. An intake filter is provided within the intake nozzle to aid filtration of water passing into the intake nozzle. An elongate output hose is connected to the pump outlet at its intake end and has a shower head nozzle connected to its output end. The shower head nozzle has an opening to permit showering using water passing through the output hose. To filter and purify water passing through the intake hose, a primary filter is disposed between the intake hose output end and the pump inlet.

In these respects, the showering device according to the present invention substantially departs from the conventional concepts and designs of the prior art, and in so doing provides an apparatus primarily developed for the purpose of enabling a user to shower for extended periods of time without using a substantial volume of water.

SUMMARY OF THE INVENTION

In view of the foregoing disadvantages inherent in the known types of showering devices now present in the prior art, the present invention provides a new showering device construction wherein the same can be utilized for enabling a user to shower for extended periods of time without using a substantial volume of water.

The general purpose of the present invention, which will be described subsequently in greater detail, is to provide a new showering device apparatus and method which has many of the advantages of the showering devices mentioned heretofore and many novel features that result in a new showering device which is not anticipated, rendered obvious, suggested, or even implied by any of the prior art showering devices, either alone or in any combination thereof.

To attain this, the present invention-generally comprises a housing unit having a hollow interior, a pump having an inlet and outlet, the pump being disposed within the housing unit. A heater is included within the pump to heat water passing through the pump. An elongate intake hose has an output end connected to the pump inlet and an intake end extending outwardly from the housing unit. An intake nozzle is connected to the intake hose intake end and has an intake opening for positioning within a reservoir containing water. An intake filter is provided within the intake nozzle to aid filtration of water passing into the intake nozzle. An elongate output hose is connected to the pump outlet at its intake end and has a shower head nozzle connected to its output end. The shower head nozzle has an opening to permit showering using water passing through the output hose. To filter and purify water passing through the intake hose, a primary filter is disposed between the intake hose output end and the pump inlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new showering device apparatus and method which has many of the advantages of the showering devices mentioned heretofore and many novel features that result in a new showering device which is not anticipated, rendered obvious, suggested, or even implied by any of the prior art showering devices, either alone or in any combination thereof.

It is another object of the present invention to provide a new showering device which may be easily and efficiently manufactured and marketed.

It is a further object of the present invention to provide a new showering device which is of a durable and reliable construction.

An even further object of the present invention is to provide a new showering device which is susceptible of a low cost of manufacture with regard to both materials and labor, and which accordingly is then susceptible of low prices of sale to the consuming public, thereby making such showering device economically available to the buying public.

Still yet another object of the present invention is to provide a new showering device which provides in the apparatuses and methods of the prior art some of the advantages thereof, while simultaneously overcoming some of the disadvantages normally associated therewith.

Still another object of the present invention is to provide a new showering device for enabling a user to shower for extended periods of time without using a substantial volume of water.

Yet another object of the present invention is to provide a new showering device which includes a housing unit having a hollow interior, a pump having an inlet and outlet, the pump being disposed within the housing unit. A heater is included within the pump to heat water passing through the pump. An elongate intake hose has an output end connected to the pump inlet and an intake end extending outwardly from the housing unit. An intake nozzle is connected to the intake hose intake end and has an intake opening for positioning within a reservoir containing water. An intake filter is provided within the intake nozzle to aid filtration of water passing into the intake nozzle. An elongate output hose is connected to the pump outlet at its intake end and has a shower head nozzle connected to its output end. The shower head nozzle has an opening to permit showering using water passing through the output hose. To filter and purify water passing through the intake hose, a primary filter is disposed between the intake hose output end and the pump inlet.

Still yet another object of the present invention is to provide a new showering device that heats, filters, and purifies water passing through it.

Even still another object of the present invention is to provide a new showering device that recycles water through it during showering.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
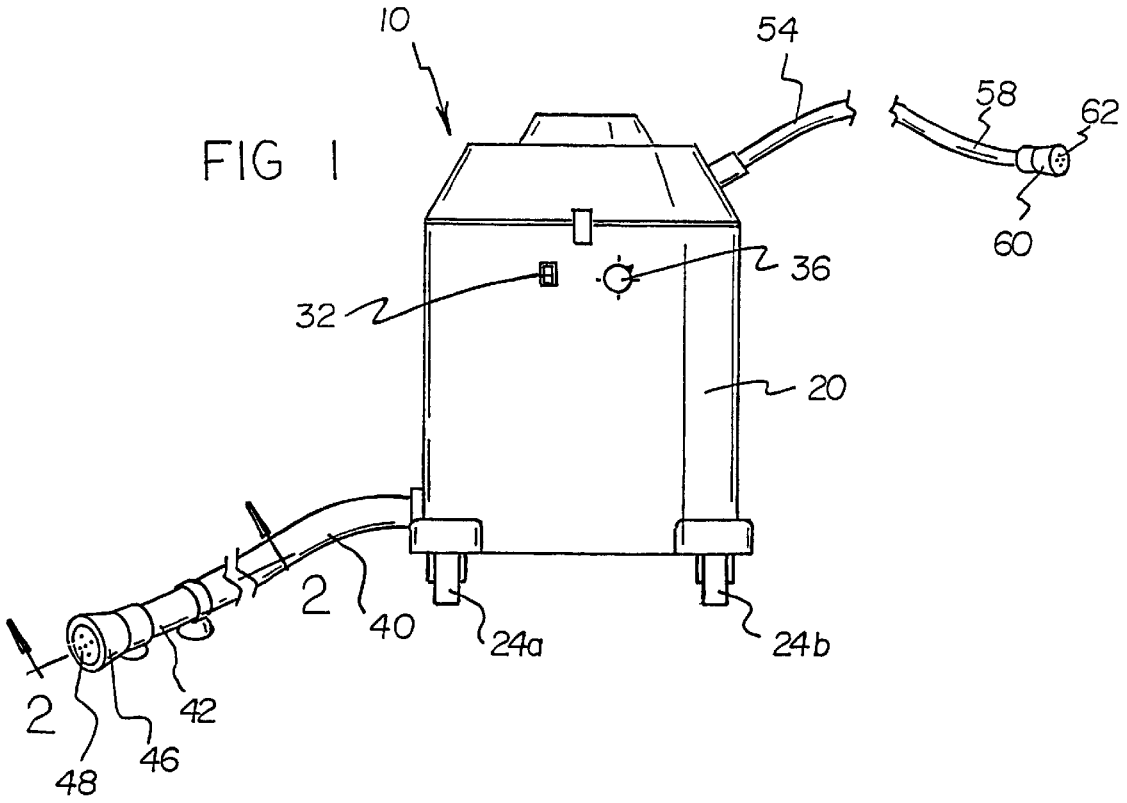
FIG. 1 is a schematic side view of a new showering device according to the present invention.

With reference now to the drawings, and in particular to FIGS. 1 through 4 thereof, a new showering device embodying the principles and concepts of the present invention and generally designated by the reference numeral 10 will be described.

The showering device 10 is designed for use with a reservoir containing water such as a tub, a pool, a lake, or a stream.

As best illustrated in FIGS. 1 through 4, the showering device 10 generally comprises a housing unit 20, a pump 26, an elongate intake hose 40 and an elongate output hose.

The housing unit 20 has a hollow interior 22. Preferably the housing unit 20 also has a plurality of caster wheels 24*a–d* provided on it exterior to help move the shower device 10 to different reservoir locations.

The pump 26 has an inlet 28 and outlet 30. The pump 26 is disposed within the housing unit 20. The pump 26 is designed for pumping water drawn in from the inlet 28 to the outlet 30. Preferably, the pump 26 includes a switch means 32 for selectively activating the pump 26.

Preferably, there is a heater 34 included within the pump 26. The heater 34 is included in the pump 26 for heating water passing through the pump 26. Ideally, the heater includes a temperature adjustment means 36 for adjusting the amount of heat provided to the water by the heater 34.

The elongate intake hose 40 has an intake end 42 and an output end 44. The output end 44 is connected to the pump inlet 28. The intake end 42 extend outwards from the housing unit 20. Preferably, the intake hose 40 is flexible so that it may be selectively and adjustably positioned into a water reservoir.

Connected to the intake end 42 is an intake nozzle 46. The intake nozzle 46 has an intake opening 48. The intake opening 48 is intended for being positioned within the water reservoir below the surface of the water so that water may be drawn into the intake hose 40. Optionally, the intake nozzle 46 may be made of a rubber coated metal to insure that the intake opening 48 is kept below the water surface and to help prevent damage to the surface of the reservoir by collisions with the intake nozzle 46.

Figure 2:
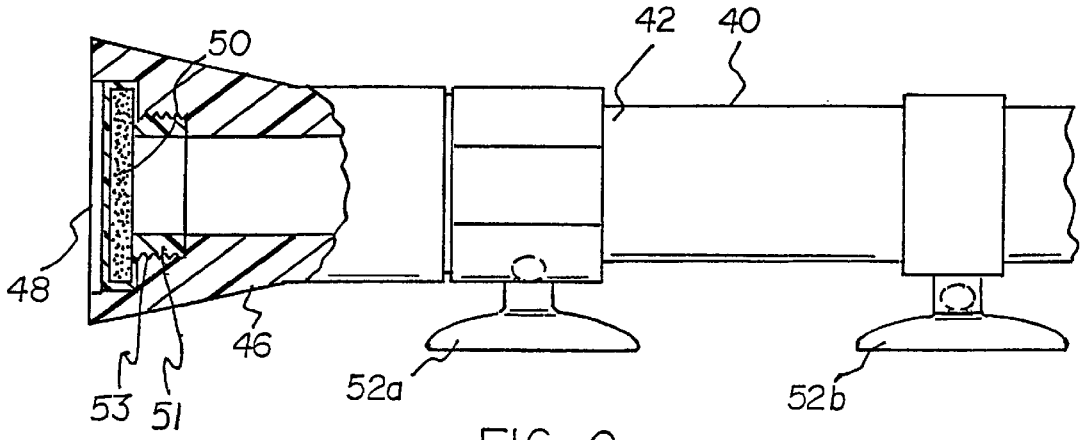
FIG. 2 is a partially exposed sectional view of the intake nozzle showing the intake filter taken from line 2—2 on FIG. 1.
Figure 3:
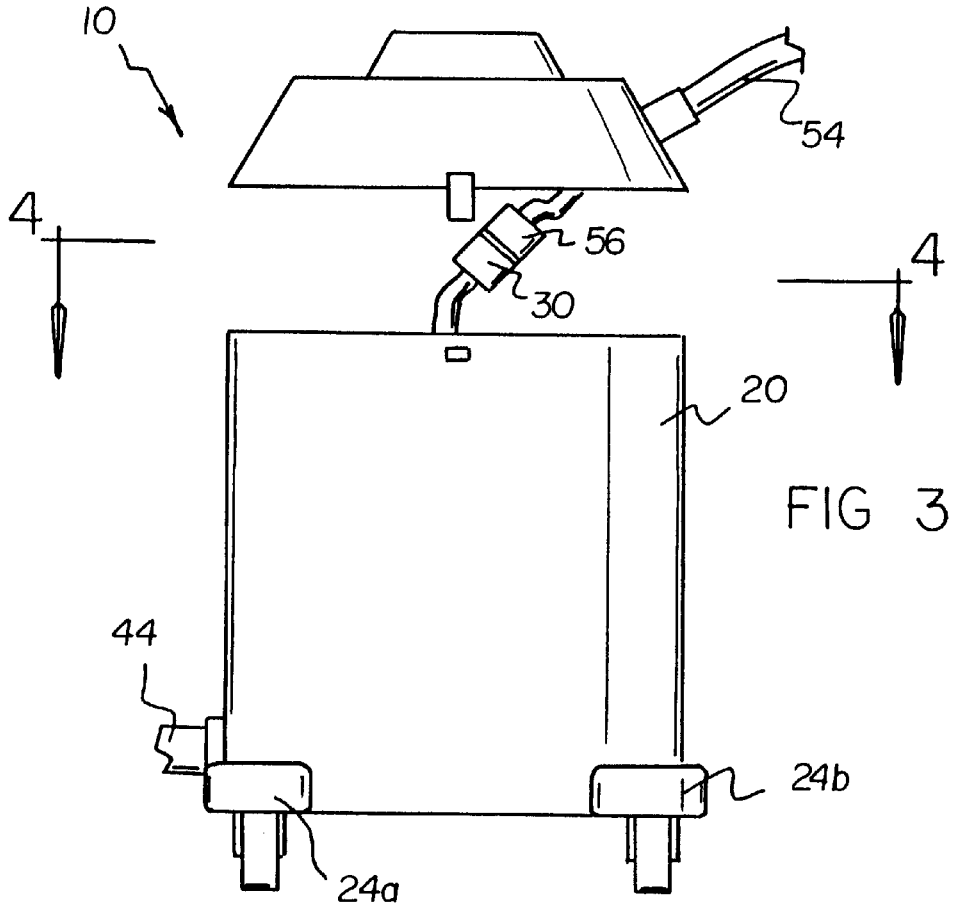
FIG. 3 is a schematic exploded partial side view of the present invention.
Figure 4:
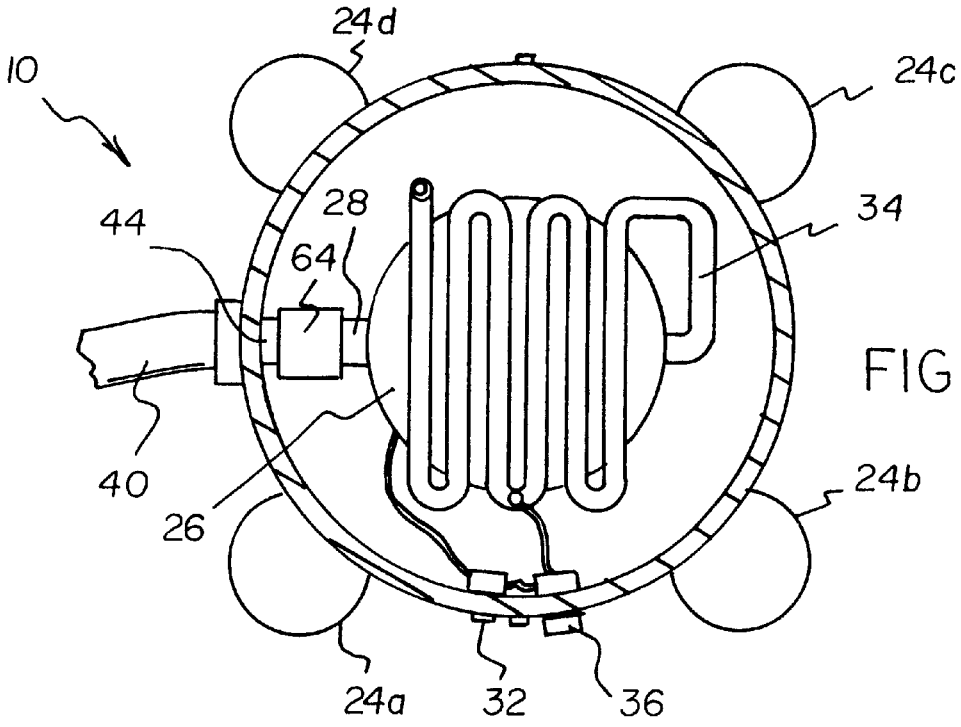
FIG. 4 is a top side view taken from the perspective of line 4—4 of the interior of the housing unit showing the pump and heater.

The showering device 10 also includes an intake filter 50 that is provided within the intake nozzle 46. The intake filter 50 aids filtration of debris from water passing into the intake nozzle 46. The intake filter 50 includes a cartridge 51 (see FIG. 2) being threadedly mounted by threads 53 on the intake nozzle 46 in a manner permitting removal of the intake filter 50 from said intake nozzle through the intake opening 48 without removing the intake nozzle from the intake hose, as shown in FIG. 2.

Preferably, at least one suction cup 52*a,b* is attached to the intake nozzle 46 to provide a nozzle positioning means so that the intake nozzle opening 48 may be positioned within the reservoir containing water by attaching the suction cup 52*a,b* to the surface of the reservoir.

The elongate output hose 54 has an intake end 56 and an output end 58. The intake end 56 is connected to the pump outlet 30. Preferably, the output hose 54 is flexible so that the output end 58 may be selectively and adjustably positioned to during use while showering. Connected to the output hose output end 58 is a shower head nozzle 60. The shower head nozzle 60 has at least one opening 62 to permit showering by using water passing through the output hose 54. Ideally, the shower head nozzle 60 includes a massaging means commonly found on many shower heads for changing the shape and output of the water stream or spray exiting from the shower head nozzle opening.

The showering device 10 also includes a primary filter 64 which is disposed between the intake hose output end 44 and the pump inlet 28. The primary filter 64 is designed for filtering and purifying water passing through the intake hose so that the water is safe for bathing. Ideally, the primary filter 64 is also designed so that it purifies water passing through it so that the water is safe for drinking.

In use, the hosing unit 20 is positioned near a reservoir containing water. The intake hose 40 is positioned in the reservoir so that the intake nozzle intake opening 48 is positioned below the surface of the water. The intake nozzle 46 may also be secured to the reservoir by attaching the suction cups 52*a,b* to the surface of the reservoir. The pump 26 is then activated so that water from the reservoir is drawn into the intake opening 46, through the intake filter 50, and through the intake hose 40. The water is then passed to the inlet 28 through the primary filter 64 and filtered and purified by the primary filter 64. Once the water is passed into the pump 26, it is heated by the heater 34 to the desired temperature and passed through the outlet 30 to the output hose 54. The water then exits the showering device through the shower head nozzle opening 62.

To conserve water, it is recommended that the shower head nozzle 60 is positioned over the reservoir so that the exiting water is collected back into to reservoir. This permits the water that has passed through the showering device 10 to be recycled again and again through the showering device 10. This way, the amount of water in the reservoir can be maintained or conserved.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable showering device for permitting showering by drawing water contained in any reservoir of water, said portable showering device comprising:

a housing unit having a hollow interior, wherein said housing unit has a plurality of caster wheels being mounted on a lower portion of said housing for permitting the housing to be rolled along a ground surface between locations of usage;

a pump having an inlet and outlet, said pump being disposed within said housing unit, said pump being for pumping water drawn into said inlet to said outlet;

a switch means being for selectively activating said pump;

a heater being included within said pump, said heater being for heating water passing through said pump;

a temperature adjustment means being for adjusting the amount of heat provided by said heater;

an elongate flexible intake hose having an intake end and an output end, said output end being connected to said pump inlet, said intake end being extended outwardly from said housing unit;

an intake nozzle having an intake opening and being connected to said intake hose intake end, said intake nozzle intake opening being for positioning within a reservoir containing water;

an intake filter being provided within said intake nozzle, said intake filter being for aiding filtration of water passing into said intake nozzle, said intake filter being threadedly mounted on said intake nozzle in a manner permitting removal of said intake filter from said intake nozzle without removing said intake nozzle from said intake hose;

a nozzle positioning means being for positioning said intake nozzle opening within said reservoir containing water, wherein said nozzle positioning means for positioning said intake nozzle opening within said reservoir containing water comprises a first suction cup attached to said intake nozzle, and a second suction cup attached to said intake hose at a distance from said first suction cup on said intake nozzle;

an elongate flexible output hose having an intake end and an output end, said intake end being connected to said pump outlet;

a shower head nozzle having an opening and being connected to said output hose output end, said shower head nozzle opening being for permitting showering using water passing through said output hose; and a primary filter being disposed between said intake hose output end and said pump inlet, said primary filter being for filtering and purifying water passing through said intake hose.

* * * * *